United States Patent [19]

Herstein

[11] Patent Number: 4,595,097

[45] Date of Patent: Jun. 17, 1986

[54] TOY PACKAGING

[75] Inventor: Barry S. Herstein, Spring Valley, N.Y.

[73] Assignee: Buddy L Corporation, New York, N.Y.

[21] Appl. No.: 695,267

[22] Filed: Jan. 28, 1985

[51] Int. Cl.[4] ..... B65D 85/68; B65D 5/50

[52] U.S. Cl. ..... 206/335; 206/45.14; 206/45.19; 383/5

[58] Field of Search ..... 206/45.14, 45.19, 521, 206/335; 229/29 B, 29 C, 29 D, 37 R

[56] References Cited

U.S. PATENT DOCUMENTS

| | | | |
|---|---|---|---|
| 3,057,466 | 10/1962 | Blonder et al. | 206/45.19 |
| 3,533,503 | 10/1970 | Wood | 206/45.19 |
| 3,576,253 | 4/1971 | Keats et al. | 206/45.14 |
| 3,847,276 | 11/1974 | Lehner et al. | 206/45.14 |
| 4,091,926 | 5/1978 | Cravens | 229/29 D |

FOREIGN PATENT DOCUMENTS

| | | | |
|---|---|---|---|
| 0208289 | 8/1959 | Austria | 206/45.14 |
| 2311725 | 12/1976 | France | 206/45.14 |

*Primary Examiner*—William Price
*Assistant Examiner*—Jimmy G. Foster
*Attorney, Agent, or Firm*—Kalish & Gilster

[57] ABSTRACT

A toy vehicle package for providing secure, open front display of the packaged vehicle. It is constructed of carton-forming sheet material, having top, bottom and side walls and a rear wall defining a toy vehicle-receiving enclosure with an open front through which the toy vehicle is insertable and displayable. The bottom wall is provided with a bottom flap configured for being folded inwardly of the enclosure to define an enclosure floor, the flap providing a vehicle-engaging configuration for engaging the vehicle after being received in the enclosure. One or more locking tabs are carried by the bottom wall for engaging the inwardly folded flap, locking the flap in its vehicle-engaging configuration to lock the vehicle against withdrawal through the open front.

7 Claims, 24 Drawing Figures

FIG. 6
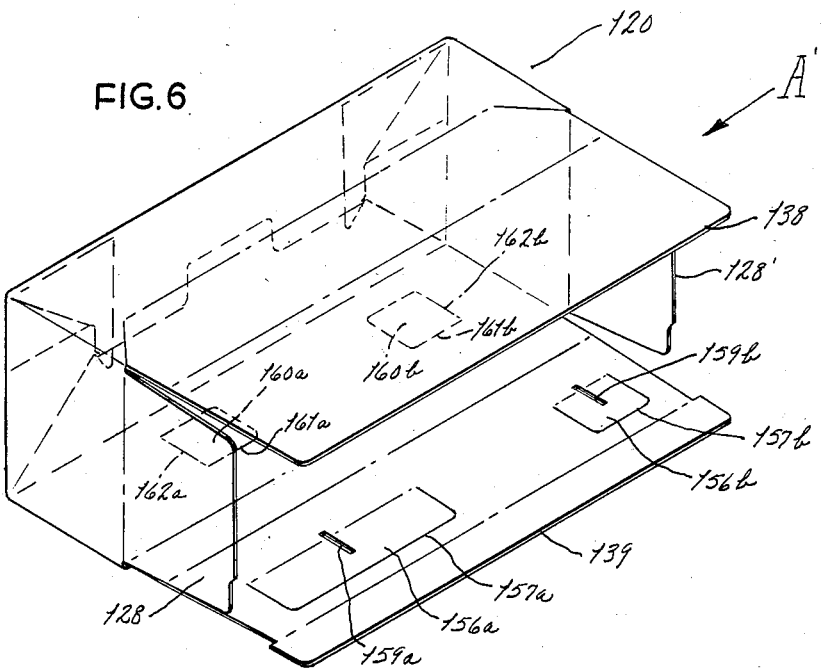
FIG. 7
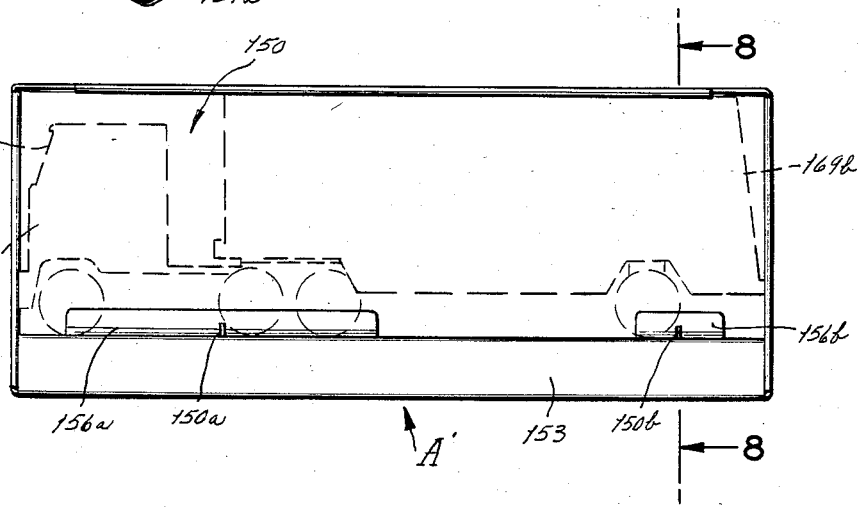
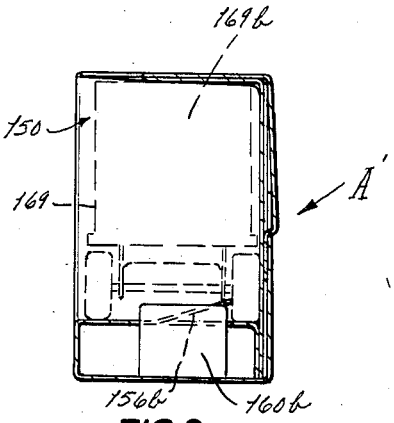
FIG. 8
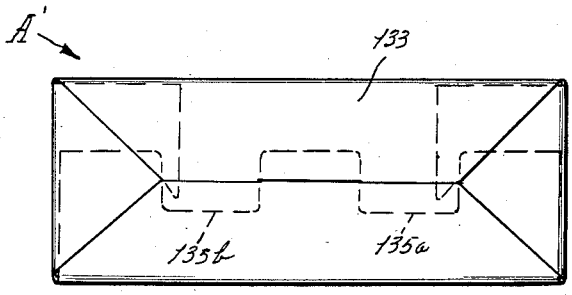
FIG. 9

FIG. 10
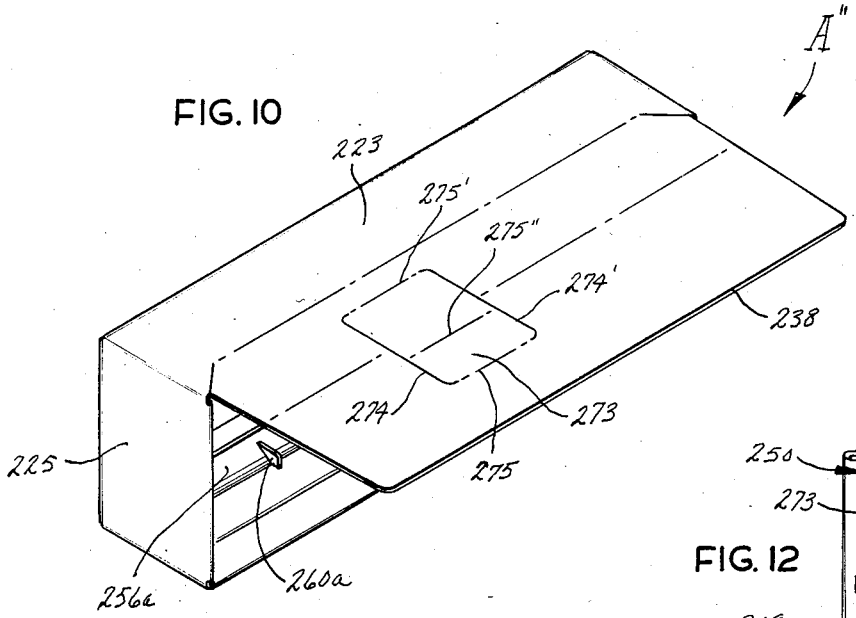
FIG. 12
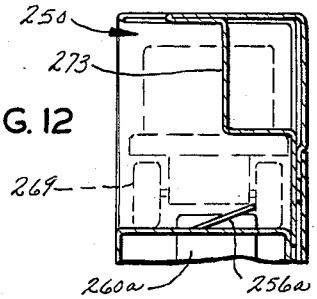
FIG. 11
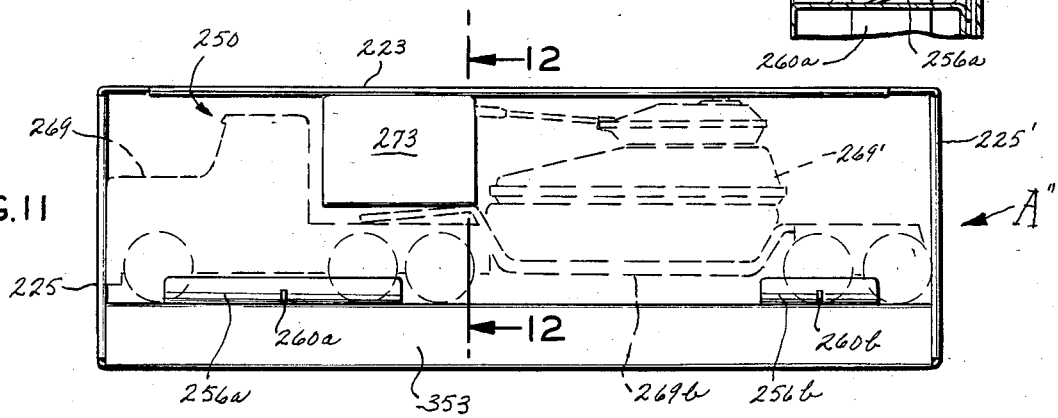
FIG. 13
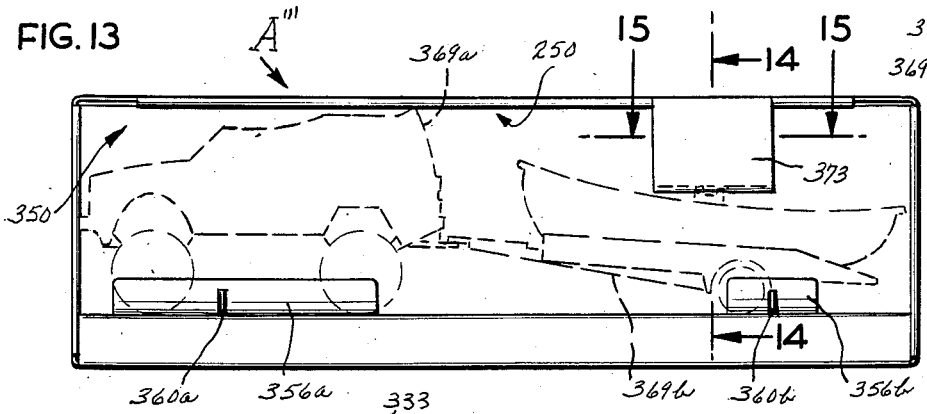
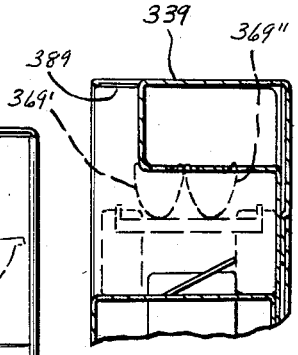
FIG. 14
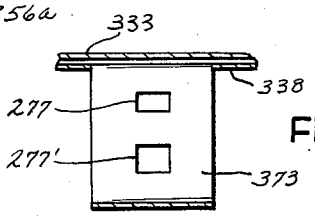
FIG. 15

FIG. 16
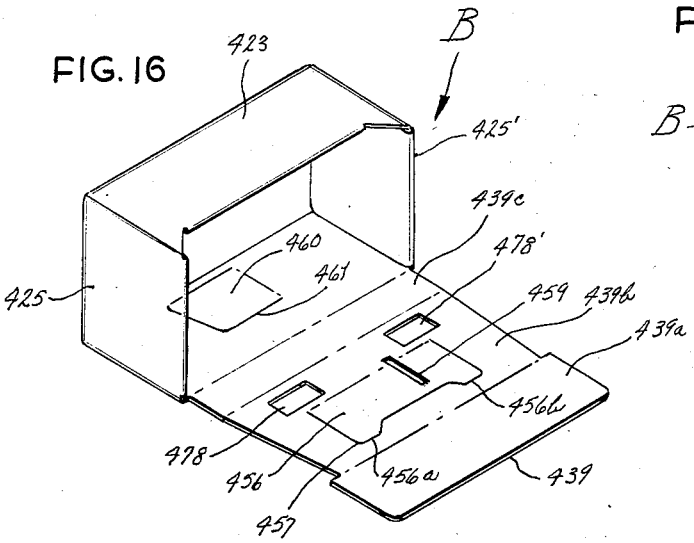
FIG. 17
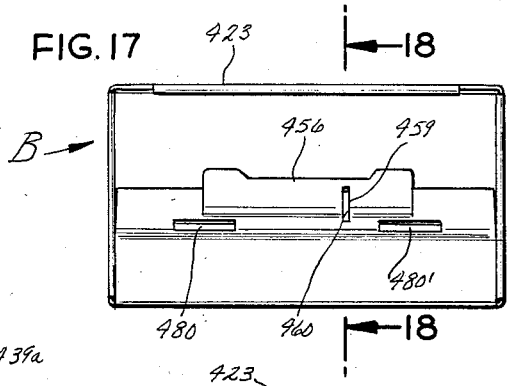
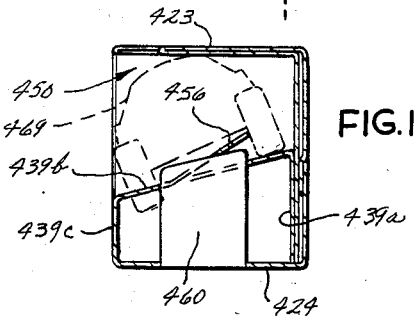
FIG. 18
FIG. 19
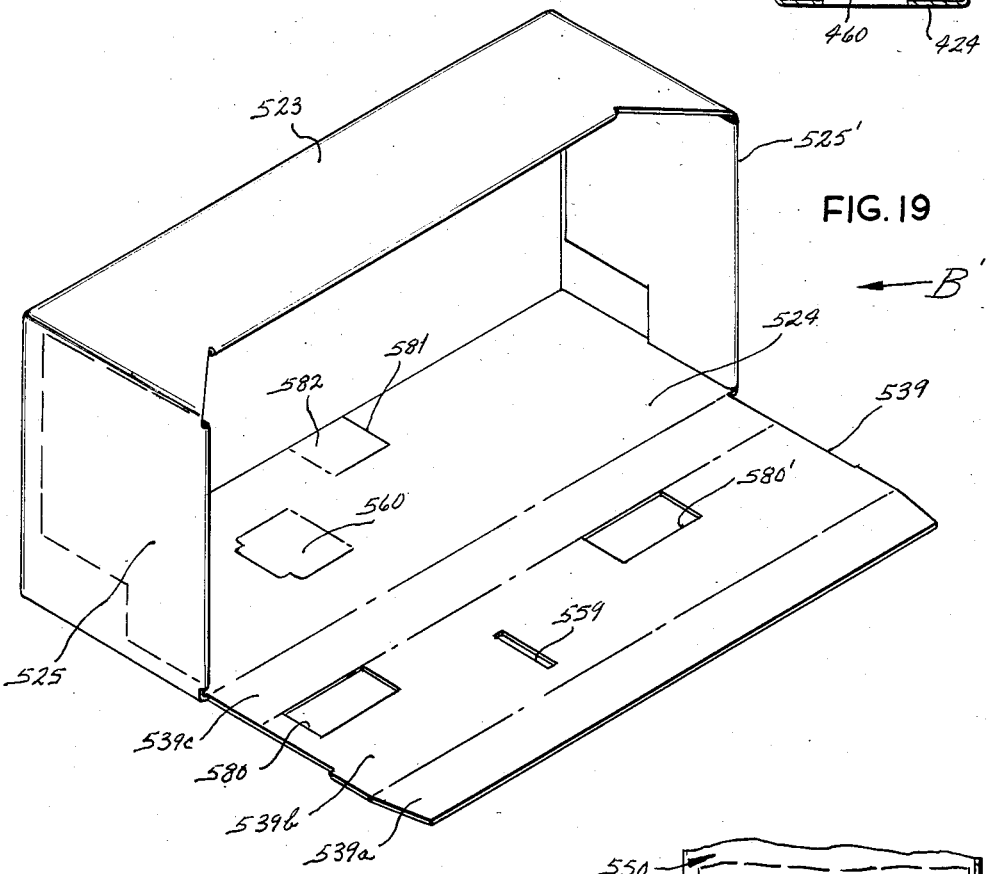
FIG. 21
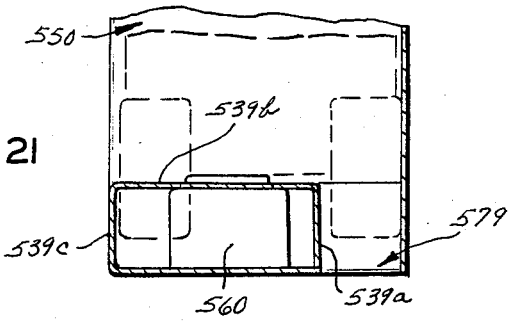

FIG. 20
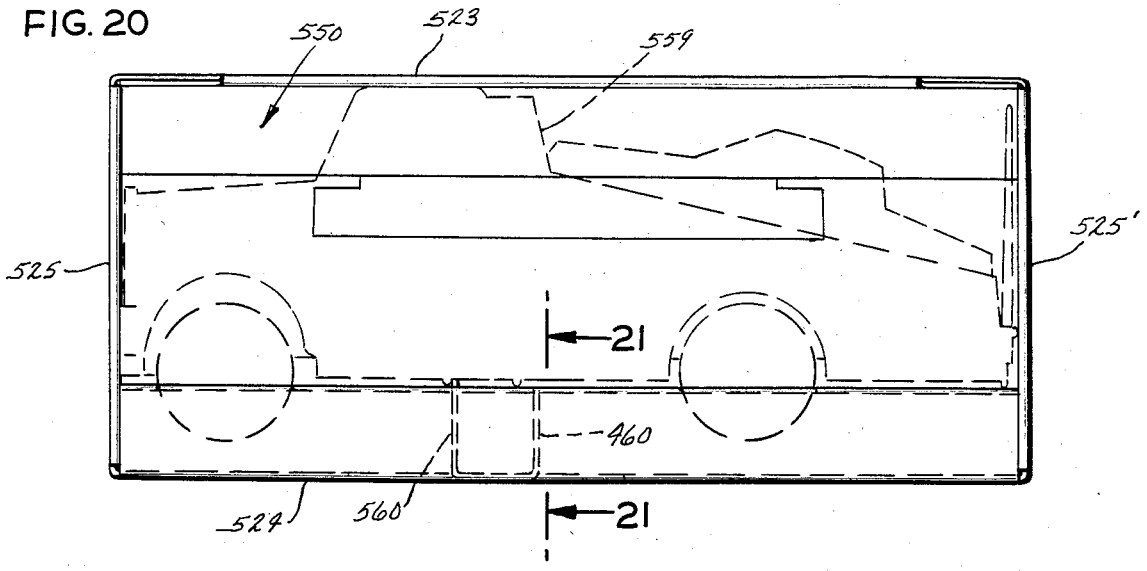
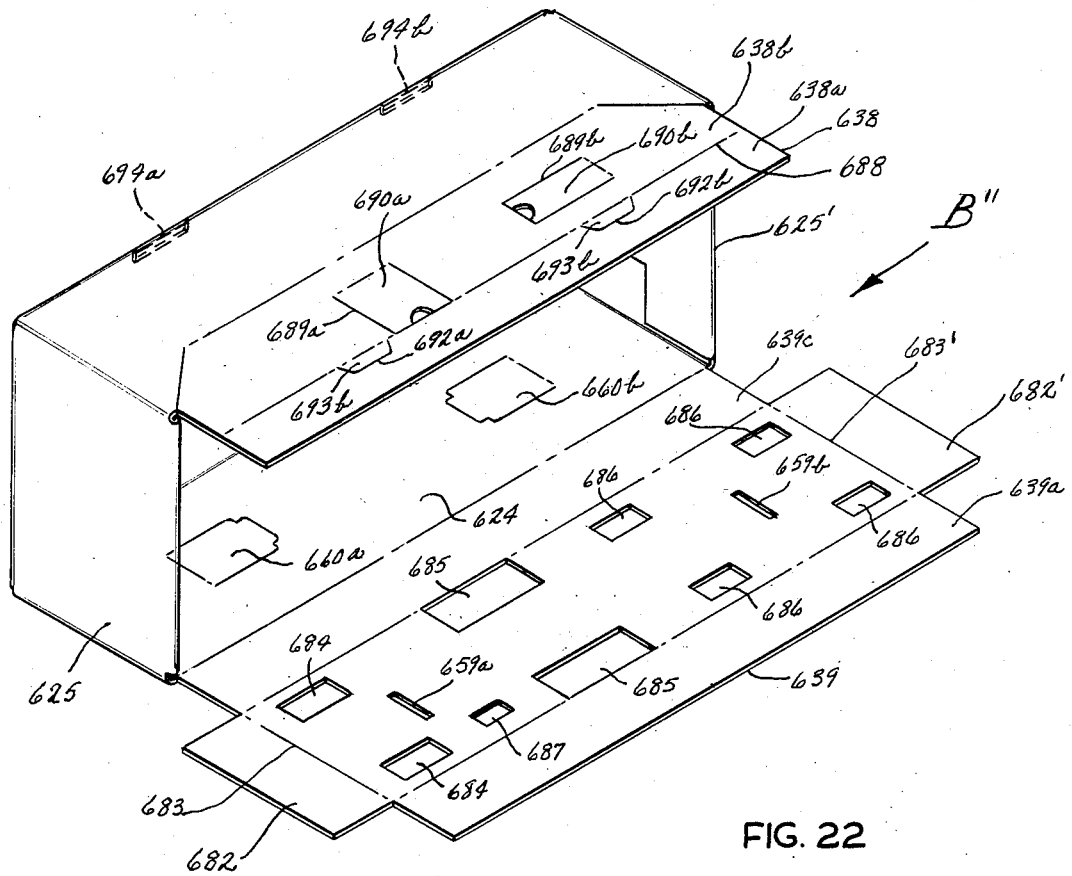
FIG. 22

TOY PACKAGING

BACKGROUND AND SUMMARY OF THE INVENTION

This invention relates to packages for toys. The successful and commercially effective packaging of toys calls in to play all of the ingenuity and skill of the toy package marketer and designer, if there is a design which packages the toy in such a way that major portions of the toy are presented for attractive and enticingly direct examination or handling while in the package. In other words, the toy must not be concealed, but instead must readily be presented for examination so that its many features, particularly in the case of toy vehicles, can be seen and even be capable of being touched by a child or prospective purchaser. Nevertheless, the packaging must be sufficiently secure as to ensure that the toy may not be removed from the packaging until after purchasing and that the package be able to survive the rigors of storage, handling, presentation and merchandising while preserving the appearance not only of the toy, but also of the package. The design problem is further complicated by a need for economy of packaging, utilizing the least amount of materials in the most effective manner and without resort to subassemblies, inserts and extrinsic fastening techniques.

Keats U.S. Pat. No. 3,576,253 of the present inventor discloses a toy package in the form of a carton having an open front through which the toy can be displayed and including terminal means preventing unauthorized removal of the toy from the carton. Such a package well protects the toy and allows its features to be readily visible from the front of the carton but requires different elements which must be assembled into a completed package. A modified version of a package disclosed in said U.S. Pat. No. 3,576,253 is formed of a single carton having enfolded flaps but does not provide universal capability of packaging for all types of toys with fully realized locking engagement of the toy within the package under all conditions.

Accordingly, among the several objects of the invention may be noted the provision of improved packaging for toys, and particularly packaging which is extremely effective and advantageous for the packaging of toy vehicles, such as trucks, tractors, cars, haulers and other such toys of a vehicular or mobile nature, including assemblies of related toys as well as toy figures; the provision of such toy packaging which provides so-called open display of the packaged toy, whether a toy vehicle or otherwise, for examination by the user along the full length of the toy; which prevents the toy from being removed once it has been inserted in the package without destruction of the package; which is substantially immune from tampering while under display; which well survives the rigors of storage, handling, merchandising and the like while preserving the appearance of both the package and the toy; and which may be formed entirely from a single, integral cardboard blank formed into a carton and providing fully locked toy engagement when assembled into a package for toys.

Other objects will be in part apparent and in part pointed out below.

DESCRIPTION OF THE DRAWINGS

FIG. 6 is a perspective view of a toy package of a second embodiment in accordance with the invention, the structure being partially folded.

FIG. 7 is a front elevation view of the package of FIG. 6.

FIG. 8 is a fragmentary vertical cross section taken along line 8—8 of FIG. 7.

FIG. 9 is a bottom plan view of the package of FIG. 6.

FIG. 10 is a perspective view of a toy package of a third embodiment in accordance with the invention, the structure being partially folded.

FIG. 11 is a front elevation view of the package of FIG. 10.

FIG. 12 is a fragmentary vertical cross section taken along line 12—12 of FIG. 11.

FIG. 13 is a front elevation view of the package of FIG. 11.

FIG. 14 is a fragmentary vertical cross section taken along line 14—14 of FIG. 13.

FIG. 15 is a fragmentary horizontal cross section taken along line 15—15 of FIG. 13.

FIG. 16 is a perspective view of a toy package of a fourth embodiment in accordance with the invention, the structure being partially folded.

FIG. 17 is a bottom plan view of the package of FIG. 16.

FIG. 18 is a fragmentary vertical cross section taken along line 18—18 of FIG. 17.

FIG. 19 is an enlarged perspective view of the package of FIG. 16.

FIG. 20 is a front elevation view of the package of FIG. 16.

FIG. 21 is a fragmentary vertical cross section taken along line 21—21 of FIG. 20.

FIG. 22 is a perspective view of a toy package of a fifth embodiment in accordance with the invention, the structure being partially folded.

DESCRIPTION OF THE PREFERRED EMBODIMENTS

Figure 1:
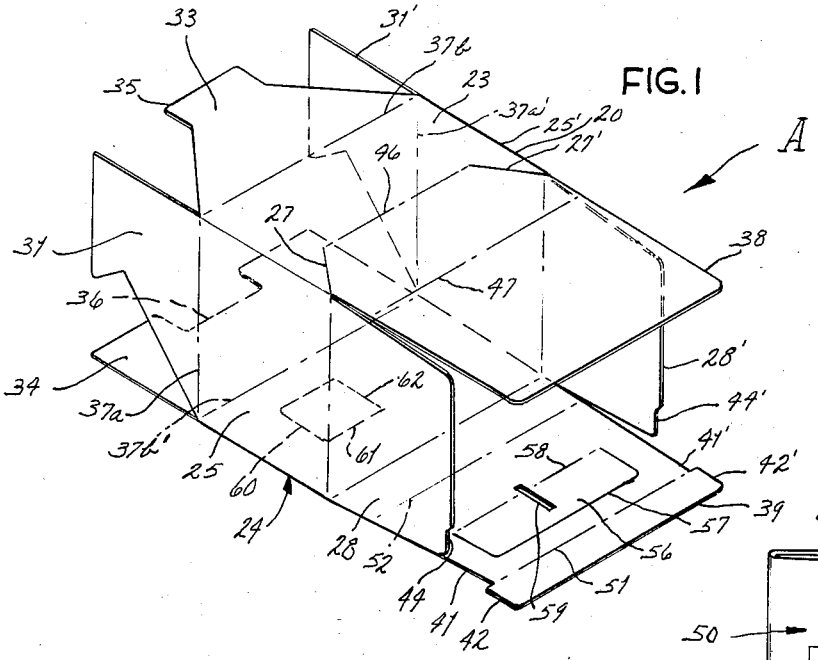
FIG. 1 is a perspective view of a toy package of a first embodiment in accordance with the invention, the elements of the package being illustrated prior to folding.
Figure 2:
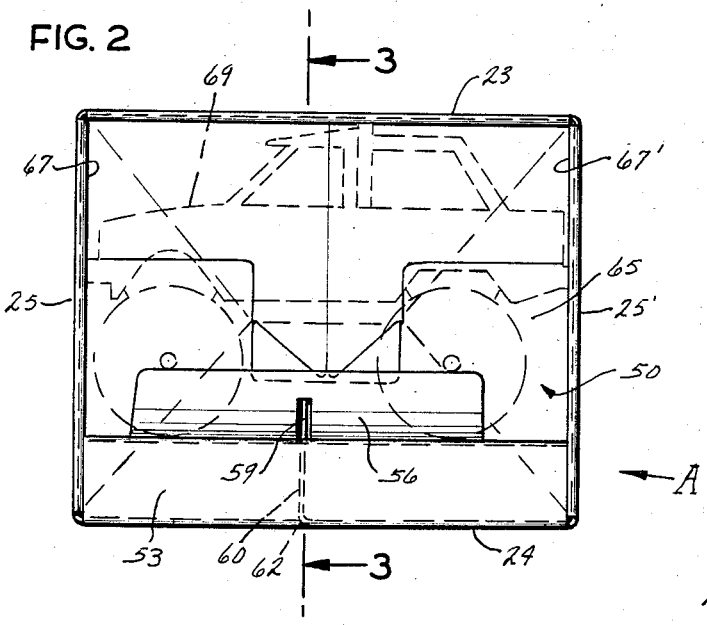
FIG. 2 is a front elevation view of the package of FIG. 1.

Referring to FIGS. 1-5, a first version A of a toy package according to the invention is formed of a rectangular carton 20 of cardboard. It includes a main body portion formed of a top wall 23, bottom wall 24 and side walls 25, 25' and whereby the carton is of tubular, rectangular configuration. Extending forwardly from the side walls are respective front side flaps 28, 28', while extending rearwardly from the side walls are respective rear side flaps 31, 31' each of which is provided in its lower edge with a V-shaped notch. Similarly, there are rear upper and lower flaps 33, 34, the upper flap 33 being tapered and including a tab 35 for interengaging with a corresponding slot 36 of the lower flap 34. Such rearwardly extending flaps 31, 31' and 33, 34 are respectively foldable inwardly upon rectilinear lines of fold 37*a*, 37*a'* and, 37*b*, 37*b'*, for forming a rear wall of the carton in which will be received a toy vehicle, such as outlined in phantom in FIGS. 2 and 3.

In like fashion, extending forwardly from the upper and lower side walls 23, 24 are respective upper and lower front flaps 38, 39, both of primarily rectangular character but with the lower flap 39 provided with shallow recesses 41, 41' of a tapered character which diverge inwardly from the side edges of the lower flap but terminating short of the outer edge to create a pair of locking tabs 42, 42' proximate the outer edge. Each of the side flaps 28, 28' is provided at its lower corner with a short vertical recess 44, 44'.

Figure 3:
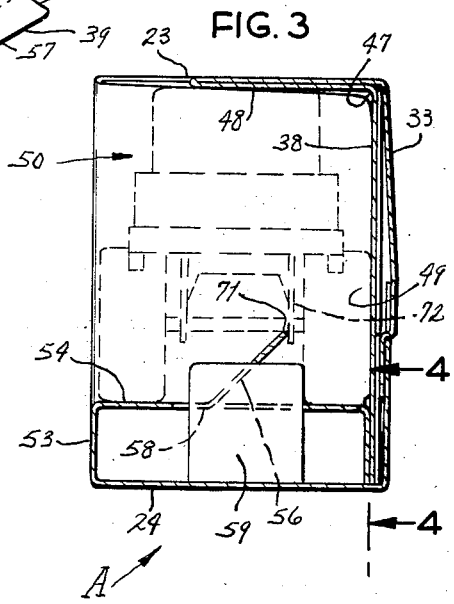
FIG. 3 is a vertical cross section taken along line 3—3 of FIG. 2.
Figure 4:
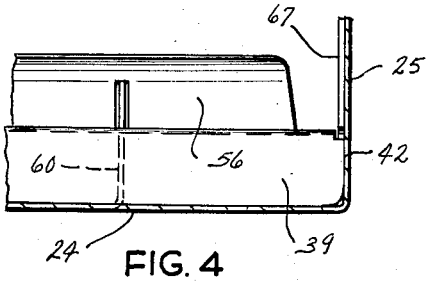
FIG. 4 is an enlarged fragmentary vertical cross section taken along line 4—4 of FIG. 3.
Figure 5:
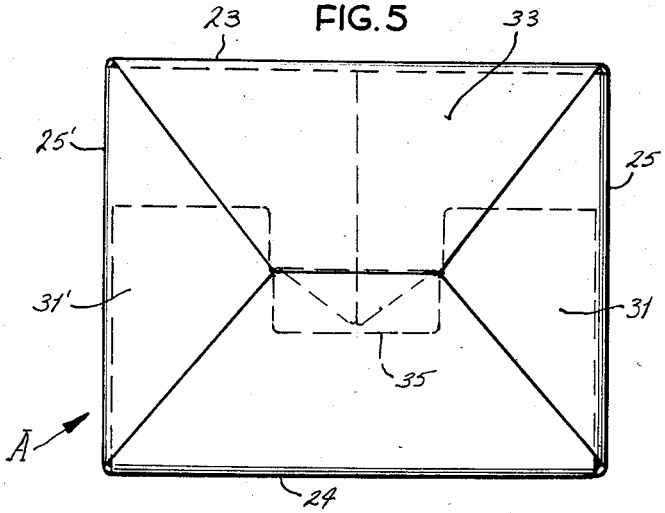
FIG. 5 is a bottom plan view of the package of FIG. 1.
Figure 23:
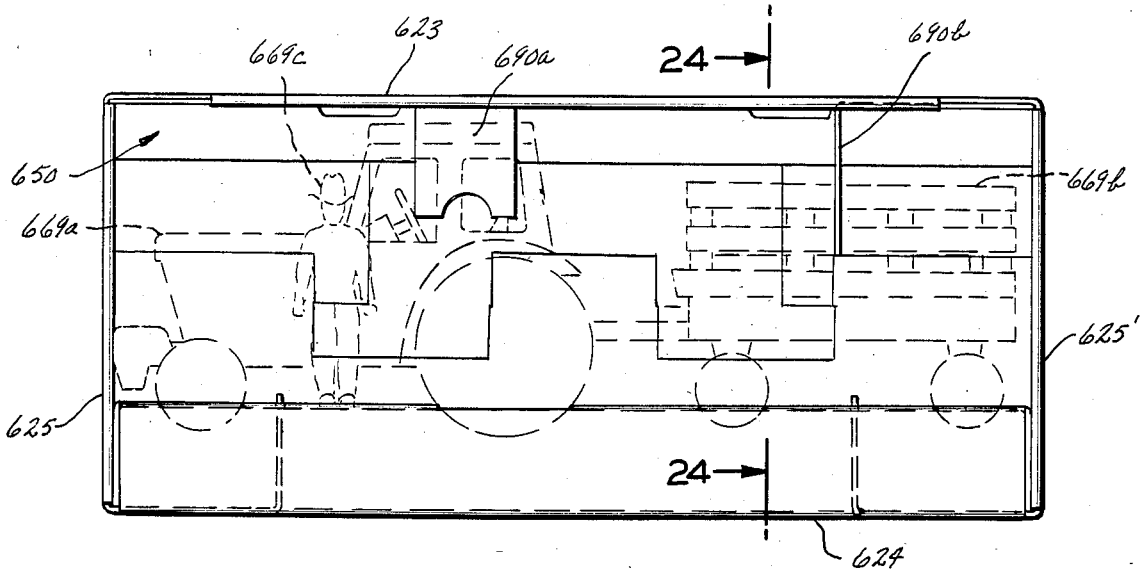
FIG. 23 is a front elevation view of the package of FIG. 22.
Figure 24:
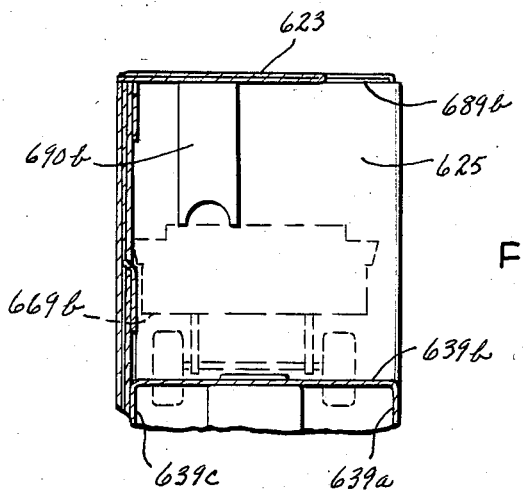
FIG. 24 is a fragmentary vertical cross section taken along line 24—24 of FIG. 23.

In accordance with the invention, the upper front flap 38 is hinged to the top wall 23 by a transverse line of weakness, or crease, 46 from the opposite ends of which cuts 27, 27' extend diagonally in diverging relationship outwardly toward the upper front corners of the main body portion. A further crease or line of weakness 47 is provided remote from line 46 whereby the upper flap 38 may be bent downwardly first from line 46 and then pressed inwardly, by bending upon line 47 to place the upper front flap 38 proximate the rear of the package, as shown in FIG. 3, in which orientation front flap 38 extends in overlying relationship over the folded rear flaps 33, 34, and 31, 31'. Accordingly, the outer surface of upper flap 38 provides both the roof 48 and the rear wall 49 of a compartment, designated generally at 50, of the package.

In like fashion, lower flap 39 is provided two lines of weakness or creases 51, 52 which permit the lower flap to be folded to provide outer portion 53 and a floor portion 54 of compartment 50, and with the portion carrying said tabs 42, 42' being folded downwardly against the rear wall-defining outer surface of upper tab 38, and said tabs 42, 42' then locking the components in place as demonstrated in FIG. 3.

A tab 56 of rectangular character is also defined in lower flap 39 by means of a U-shaped cut 57, flap 49 being then hingedly secured to the remainder of the lower flap by a crease or line of weakness 58, across which a rectangular slot 59 extends centrally of tab 56. Slot 59 is for locking purposes, being intended to receive a tab 60 formed in the bottom wall 24. Tab 60 is also rectangular, being similarly formed by a U-shaped cut 61 oriented for permitting tab 59 to be bent about a line of weakness or crease 62 extending longitudinally and substantially centrally of the bottom wall 24.

Accordingly, compartment is defined by the main body portion comprised of elements 23, 24, 25 25' but lined interiorly with the outer surfaces of the upper front flap 38 which serve to provide the roof 48 and rear wall 49 of compartment 50. Similarly, the front side flaps 28, 28', when folded inwardly following the inward folding of the front flap 38, define the compartment interior side walls 67, 67'. In like manner, the compartment floor 54 is defined by outer portions of the lower front flap 39, there being a vertical lower base of the package, as at 53 below floor 54, for presentation of trade markings and product indentification. In the preferred sequence of assembly, the lower front flap 39 is last to be folded inwardly, with its outer edge being turned downwardly for locking of tabs 42, 42' in place.

In forming the package, the rear flaps are first folded, lower flap 34 being raised initially and the side flanges 31, 31' being then secured by engagement within recess 36 (FIG. 5), and with the upper flap 33 finally directed downwardly with its tab 35 also inserted within recess 36.

The resultant construction allows coloring and graphical information and trademarks and other printing to be entirely upon the outer surface of the flaps and main body portions, leaving the interior cardboard surfaces of plain, uncoated and unprinted character as desired. The resultant toy package thereby has color presented on all visually observable surfaces but is formed from a blank piece of material printed upon one side only.

The toy-receiving recess 50 which results is of rectangular character, being entirely suitable for receiving a toy vehicle such as the stylized, high-wheeled pick-up truck 69 shown in phantom. In order to then lock and secure such vehicle 69 within the compartment, flap 60 is pressed upwardly from the bottom wall 24 during the packaging operation, causing flap 60 to bend about line 62, and causing tab 56 to be deflected upwardly until its upper outer extremity as shown at 71 engages the vehicle suspension members inwardly of its wheels, as at 72, which lie along the compartment rear wall 65. If tab 60 is further moved upwardly into vertical orientation, it slides into and is locked within slot 59, where it remains, keeping tab 56 in its upwardly deflected, locked position at all times throughout the shipping, display and other handling of the resultant toy package.

The construction realized securely retains the vehicle within compartment 49, allowing it to be readily observed by a prospective purchaser, and all of its features being capable of being studied at close range, the vehicle for all intents and purposes thereby openly revealed and even touchable by a child or prospective purchaser while nevertheless at all times remaining locked and secured within the compartment 50 and not removable therefrom without package destruction by the ultimate user. However, unless the package is destroyed, the toy may not be withdrawn from the package since the upright toy-locking tab 56 is of sufficient length, as extending under the longitudinal extent of the vehicle, thus engaging the inner surfaces of both front and rear tires of the vehicle which tires lie along the back wall of the compartment 50, or which tab otherwise engages the vehicle structure in a locking manner. Further, tab 56 is long enough to extend under both front and rear axles of the vehicle and thus the toy may not be permitted to be twisted for removal.

FIGS. 6–9 demonstrate an embodiment A' which illustrates the application of the principles of the invention to an elongated toy package, as for receiving a toy vehicle 169 of the semi-trailer type, the same having a tractor 169*a* with its customary front and rear wheels, as well as a trailer 169*b* with only a set of rear wheels.

Accordingly, utilizing the same type of folded construction as for embodiment A, the elongated embodiment A' includes a floor 124 in which are defined a pair of tabs 160*a*, 160*b* defined by oppositely oriented U-shaped cuts 161*a*, 161*b* and foldable upon creases or lines of weakness 162*a*, 162*b* upwardly for respectively locking into place locking tabs 156*a*, 156*b* formed within the lower front flap 139. Each of these tabs is provided with a vertical transecting slot 159*a*, 159*b* so that the locking tabs 156*a*, 156*b* will be locked into the vehicle-securing orientation shown in FIGS. 7 and 8 in precisely the same manner as for embodiment A. Because of its longer extent, tab 156*a* is of sufficient length, as well as being placed close to the left edge of the compartment 150, so that it may extend under both the front and rear wheels of the tractor 169*a*. Tab 156*b* is dimensioned and located for solely the rear wheels of the trailer 169*b*.

Further, embodiment A is formed of an elongated carton 120 wherein the upper rear flap 133 is formed with a pair of tabs 135*a*, 135*b*, thus enhancing the security of the rear of the carton, but otherwise the front flap 138 is similarly first inwardly folded, followed by the side flaps 128, 128' and then the bottom flap 139 which serves, as in the previous version, to establish a vertical base 153 upon which appropriate legends and trade markings may be provided.

In FIGS. 10–12, a version A" of the invention illustrates the formation of a carton like that utilized for version A' but wherein the upper front flap 238 is provided with a rectangular area 273 defined by a pair of parallel, rectilinear cuts 274, 274' which terminate in creases or lines of weakness 275, 275' and across which areas extends a further line of weakness or crease 275'''. Otherwise, the components of package A''' are in substantial correspondence with those of A'. Thus, there are provided a pair of upstanding vehicle-locking tabs 256*a*, 256*b* which are caused to be maintained in locked configuration by tab-locking tabs 260*a*, 260*b* whereby the vehicle 269 is maintained securely within the package compartment 250 by engagement of its wheels, axle structure, or suspension, etc., as demonstrated in FIG. 12.

However, the vehicle 269 shown is one having a trailer 269*b* of flat-bed configuration upon which is located a toy tank 269'. Thus, the purpose of area 273 now becomes apparent, namely that when upper flap 238 is folded into the package, bending about its line of weakness 247, area 273 will be caused to take the form shown in FIG. 12, and presenting a protrusion into the space of compartment 250 such as will lock the trailer portion 269*b* of vehicle 269 thus positioning and preventing also displacement of the tank toy 269', it being apparent that cut 275''' is placed in a location relative to area 273 for bringing about this novel locking function.

FIGS. 13–15 further illustrate a version A''' wherein such an area 373 of the upper front flap 339 is formed with a pair of rectangular openings 277, 277' such as for providing locking engagement of a toy structure with upward protrusions. A toy of this nature is representated in FIGS. 13 and 14 as being a pair of canoes 369', 369" located upon a trailer 369*b* of a vehicle 369 within compartment 350. Thus, the resulting rectangular protrusion to compartment 350 will lock the trailer structure in position and also prevent displacement of otherwise readily movable items such as canoes or other trailered toys, as by interengagement of same with openings 277, 277'. Otherwise, the vehicle-locking tabs 356*a*,356*b* provide the same function as before, being locked in place by tab-locking tabs 360*a*, 360*b*.

FIGS. 16–18 illustrate an embodiment B wherein the bottom front flap 439 is provided not with a U-shaped cut, but one of modified W-shape indicated at 457 whereby the resultant vehicle-locking tab 456 will have two projections 456*a*, 456*b* to be received by central recesses of the inner wheels of a vehicle 469 received in the compartment 450 defined by the package.

Furthermore, the lower flap 439 is defined into three areas 439*a*, 439*b*, 439*c* wherein area 439*a* is in substantial extent compared with area 439*c* and so, when tab 439 is folded inwardly, area 439*b* defines a sloping floor for enhancing the display of the toy vehicle 469. Additionally, area 439*b* is provided with two rectangular openings 478, 478' dimensioned and spaced for receiving the outer wheels of the vehicle, as received in the compartment 450. Consequently, as FIG. 18 demonstrates, the vehicle takes on an increasing slope outwardly of the compartment to illustrate even more clearly its upper and top-defining features. Yet, when the vehicle-locking tab 456 is extended upwardly into position and in turn locked into place by tab 460, the vehicle is reliably secured in its compartment, safe against removal.

Version B', demonstrated in FIGS. 19–21, illustrates the application of such features to another form of the package wherein the lower front flap 539 again is divided into three areas, 539*a*, 539*b*, 539*c*, but areas 539*a* and 539*c* are of comparable depth and area 539*b* is of lesser depth than either of side walls 525, 525'. Accordingly, when flap 539 is folded inwardly with area 539*a* directed downwardly, gap or recess 579 is provided ror receiving the inner wheels of the vehicle to be packaged and displayed. Additionally, U-shaped cut-outs 580, 580' are provided within area 539*b*, being spaced and dimensioned for receiving the outer wheels of the vehicle. The carton floor 524 is provided, in addition, to flap 560 with a U-shaped cut 581 for defining a flap 582 which may be directed outwardly during packaging to rigidly define the gap or spacing 579 for maintaining flap portion 539*a* in vertical orientation. However, area 539*b* is not provided with an upstanding locking flange but rather slot 559 for receiving the locking tab 560 and thereby maintaining, together with tab 582, the folded lower flap in its orientation depicted in FIG. 21. Thus, it may be said that when folded, lower flap 539 itself defines the locking structure for the vehicle, as it will be seen that portion 539*b* extends under and along the undersurface of the vehicle with portion 539*a* preventing the vehicle from being withdrawn. Even if a determined youngster were to be able to pry the outer wheels from their recesses defined by cuts 580, 580', it will still be impossible to withdraw the vehicle.

A version B" demonstrates the features of the latter version into a package for containment of a tractor 669*a* but also a wagon 669*b* and one or more figures, as at 669*c*. For this construction, the lower flap 639 is divided into outer and inner areas 639*a*, 639*c* of equal extent and a central area 639*b* of extent slightly shorter than the depth of the side walls 625, 625' and provided at its opposite ends with flaps or tabs 682, 682' defined by respective creases or lines of weakness 683, 683' for facilitating downward folding of such tabs when the flap is inserted within the package. Also, central portion 639*b* is provided with a number of wheel-receiving cutouts as at 684, 685 and 686, as well as one or more auxiliary cutouts or apertures 687 as necessary for receiving extrinsic toy structures such as the farmer FIG. 669*c*. In addition, two slots 659*a*, 659*b* for receiving tabs 660*a*, 660*b* defined by cuts in the carton floor 625. Accordingly, when the bottom flap is folded inwardly, its central portion 639*b* defines the floor of the toy compartment and its portion 639*a* lies along the compartment back wall. When thus inwardly folded, lower flap 639 is reliably retained and locked in place, and thereby locks the toy vehicles in place by reception of tabs 660*a*, 660*b* within their respective slots 659*a*, 659*b*.

The upper flap 638 is divided into areas 638*a*, 638*b* by a line of fold or crease 688. U-shaped cuts 689*a*, 689*b* are additionally provided therein for defining respective tabs 690*a*, 690*b* and two additional U-shaped cuts 692*a*, 692*b* define respective tabs 693*a*, 693*b*. The latter tabs are adapted to be received by respective slots 694*a*, 694*b* provided at the upper rear corner of the container for causing the flap 638, when folded inwardly, to be reliably locked in place.

Tabs 690*a*, 690*b* are directed downwardly from the upper flap when in this orientation for engaging and locking the toy structure in place and ensuring that the vehicle may not be raised substantially above the compartment 650 floor defined by lower flap central portion 639*b*.

Although the toy vehicle packages of the invention are preferrably formed of cardboard or other paperboard materials, it is clear that the invention may be utilized as well for toy vehicle packages formed of other comparably stiff, resilient, yieldable carton-forming sheet material including synthetic materials.

In view of the foregoing, it will be seen that the several objects of the invention and other advantages are achieved by the new constructions which have been described.

Although the foregoing includes the description of the best mode of the embodiments contemplated for carrying out the invention, various modifications are contemplated.

As various modifications could be made in the constructions herein described and illustrated without departing from the scope of the invention, it is intended that all matter contained in the foregoing description or shown in the accompanying drawing shall be interpreted as illustrative rather than limiting.

What is claimed is:

1. A package for a toy vehicle having a body and front and rear wheels for providing secure, open front display of the packaged vehicle, the package being constructed of carton-forming sheet material and having top, bottom, side and rear walls defining a toy vehicle-receiving enclosure having an open front through which the toy vehicle is insertable and visible for display purposes, with said vehicle being presented with a front and a rear wheel proximate said rear wall, said bottom wall having a bottom flap extending inwardly of the enclosure from a line of folding constructed to define a floor therefor located upwardly of said bottom wall, at least one locking tab formed in said bottom wall and being bendable upwardly from a first line of weakness in the plane of said bottom wall, said bottom flap having at least one vehicle-engaging tab formed therein bendable upwardly and extending rearwardly from a second line of weakness in the plane of said floor of said bottom flap and having a free inner end for engaging the proximate wheel of the vehicle on the inner surface thereof for maintianing said vehicle against displacement, said vehicle-engaging tab having a slot located spacedly from the vehicle-engaging free end, said locking tab having an outer portion sized and located to extend through said slot and an inner portion constructed to engage said vehicle-engaging tab between the end thereof and said slot form maintaining said vehicle-engaging tab in vehicle-locking orientation.

2. A package for a toy vehicle as defined in claim 1 and further characterized by the enclosure defined by said walls being elongated in the direction of the lengthwise extent of the toy vehicle, said second line of weakness extending in the direction of elongation of the enclosure, said slot being axially perpendicular to the said second line of weakness.

3. A package for a toy vehicle as defined in claim 1 and further characterized by the vehicle-engaging tab being of sufficient length for engaging the front and rear vehicular wheels adjacent the rear wall of said package.

4. A package for a toy vehicle according to claim 1 and further characterized by the first line of weakness being axially perpendicular to said second line of weakness, said slot extending from a point spacedly from the line of folding of said bottom flaps to a point spacedly from the free inner end of said vehicle-engaging tab, said locking tab being of greater transverse extent than the length of the related slot whereby the inner portion of said locking tab engages the vehicle-engaging tab at the proximate edge of said slot for supporting said vehicle-engaging tab in vehicle-engaging disposition with an adjacent portion of said locking tab being located beneath the under surface of the proximate inner portion of said vehicle-engaging tab.

5. A package for a toy vehicle as defined in claim 1 and further characterized by said top wall having a front flap bendable inwardly of said package for disposition beneath said top wall, said front flap having at least one detent tab for extension downwardly about a line of bending provided in said front flap for engaging at the lower free end of said detent tab the proximate portion of said vehicle for inhibiting upward displacement thereof.

6. A package for a toy vehicle as defined in claim 5 and further characterized by said detent tab having a lower terminal portion bendable about a second line of bending for direction inwardly, spacedly beneath said top wall, toward the rear wall of said vehicle for inhibiting upward displacement of the underlying portion of the vehicle.

7. A package for a toy vehicle having a body and front and rear wheels for providing a secured, open front display of the packaged vehicle, the package being constructed of carton-forming sheet material and having top, bottom, side and rear walls defining a toy vehicle-receiving enclosure having an open front through which a toy vehicle is insertable and visible for display purposes with said vehicle being presented with a front and a rear wheel proximate said rear wall, said bottom wall having a bottom flap, first, second and third parallel lines of weakness for dividing said bottom flap into three areas, whereby upon folding about said lines of weakness said three areas are constructed to respectively define a base below said open front, a floor upwardly of said bottom wall, and an inner end portion extending downwardly in substantially planar parallel relationship to the rear wall, said floor being provided with apertures sized for receiving lower parts of the wheels on the outer side of the vehicle, said floor being dimensioned for extension over only a portion of the bottom wall whereby said inner end portion is disposed spacedly from the rear wall to define a zone for receiving lower parts of the wheels adjacent the rear wall of said package, said floor having at least one slot extending rearwardly, and at least one locking tab formed in said bottom wall and being bendable upwardly from a fourth line of weakness in the plane of said bottom wall, said locking tab having at a free end thereof a reduced central portion sized for extension through said slot and with the portions adjacent either end of said central portion sized to form shoulders for engaging the proximate under surface of said floor.

* * * * *